US012529511B2

(12) United States Patent
Cheng et al.

(10) Patent No.: US 12,529,511 B2
(45) Date of Patent: Jan. 20, 2026

(54) ADJUSTABLE RACK DEVICE AND REFRIGERATOR HAVING THE SAME

(71) Applicants: QINGDAO HAIER REFRIGERATOR CO., LTD., Qingdao (CN); HAIER SMART HOME CO., LTD., Qingdao (CN)

(72) Inventors: Xueli Cheng, Qingdao (CN); Zhenxing Zhang, Qingdao (CN); Xiaobing Zhu, Qingdao (CN)

(73) Assignees: QINGDAO HAIER REFRIGERATORCO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 160 days.

(21) Appl. No.: 18/022,166

(22) PCT Filed: Aug. 16, 2021

(86) PCT No.: PCT/CN2021/112833
§ 371 (c)(1),
(2) Date: Feb. 19, 2023

(87) PCT Pub. No.: WO2022/037542
PCT Pub. Date: Feb. 24, 2022

(65) Prior Publication Data

US 2023/0324111 A1 Oct. 12, 2023

(30) Foreign Application Priority Data

Aug. 19, 2020 (CN) ..... 202010838194.8

(51) Int. Cl.
*F25D 25/02* (2006.01)

(52) U.S. Cl.
CPC ..... *F25D 25/024* (2013.01); *F25D 2325/021* (2013.01)

(58) Field of Classification Search
CPC ..... F25D 25/024; F25D 2325/021
(Continued)

(56) References Cited

U.S. PATENT DOCUMENTS 3,854,428 A * 12/1974 Fullenkamp ..... A47B 9/00 248/408
5,199,778 A * 4/1993 Aoki ..... F25D 25/02 108/147

(Continued)

FOREIGN PATENT DOCUMENTS

CN 2550701 Y 5/2003
CN 103528334 A 1/2014

(Continued)

*Primary Examiner* — Janet M Wilkens
*Assistant Examiner* — Timothy M Ayres
(74) *Attorney, Agent, or Firm* — Muncy, Geissler, Olds & Lowe, P.C.

(57) ABSTRACT

The present invention discloses an adjustable rack device and a refrigerator having the same; the adjustable rack device includes a rack assembly and a slide rail assembly, the rack assembly includes a rack body and a bracket, the slide rail assembly includes a rail groove, an elastic assembly, a sliding plate fixedly connected with the bracket and at least two stop positions, a first end of the elastic assembly is provided at an end portion of the rail groove located at a supporting surface of the rack body, and a second end of the elastic assembly is connected with the sliding plate and provides an elastic restoring force for the sliding plate. Gravity of an adjustable rack is not required to be overcome for work in a moving process of the rack, and the rack is more portable and labor-saving.

9 Claims, 4 Drawing Sheets

(58) Field of Classification Search
USPC ..... 312/408, 319.1
See application file for complete search history.

(56) References Cited

U.S. PATENT DOCUMENTS

| | | | | |
|---|---|---|---|---|
| 5,913,584 | A * | 6/1999 | Swindell | F25D 25/02 248/292.12 |
| 7,306,303 | B2 * | 12/2007 | Ritchie | A47B 51/00 248/244 |
| 7,337,730 | B2 * | 3/2008 | Bienick | F25D 25/02 108/108 |
| 8,152,258 | B2 * | 4/2012 | Kang | F25D 25/04 211/187 |
| 8,172,347 | B2 * | 5/2012 | Lim | F25D 25/02 312/351 |
| 8,205,563 | B2 * | 6/2012 | St. Louis | B64D 11/0638 108/42 |
| 8,210,626 | B2 * | 7/2012 | Shin | F25D 25/04 108/108 |
| 8,226,184 | B2 * | 7/2012 | Kang | A47B 57/06 312/319.1 |
| 8,333,448 | B2 * | 12/2012 | Yoon | A47B 96/028 312/351 |
| 8,419,143 | B2 * | 4/2013 | Shin | F25D 25/02 312/408 |
| 8,529,001 | B2 * | 9/2013 | Calvillo | F25D 25/02 312/408 |
| 8,757,743 | B2 * | 6/2014 | Wilson | F25D 25/04 108/108 |
| 10,330,371 | B2 * | 6/2019 | Jung | F25D 25/022 |
| 11,713,917 | B2 * | 8/2023 | De Albuquerque | F25D 11/02 62/329 |
| 11,744,358 | B2 * | 9/2023 | Harjula | A47B 9/02 108/147 |
| 11,898,793 | B2 * | 2/2024 | Xu | F25D 25/04 |
| 12,163,729 | B2 * | 12/2024 | Zhu | A47B 51/00 |
| 12,298,064 | B2 * | 5/2025 | Zhang | F25D 25/04 |
| 2005/0204966 | A1 | 9/2005 | Bienick et al. | |
| 2009/0255292 | A1 | 10/2009 | Benz | |
| 2013/0160483 | A1 * | 6/2013 | Hasturk | A47B 96/1458 312/404 |
| 2016/0187054 | A1 | 6/2016 | Park et al. | |
| 2023/0280089 | A1 * | 9/2023 | Zhu | F25D 23/066 |

FOREIGN PATENT DOCUMENTS

| | | | |
|---|---|---|---|
| CN | 203572136 | U | 4/2014 |
| CN | 203758157 | U | 8/2014 |
| CN | 104344675 | A | 2/2015 |
| CN | 107421227 | A | 12/2017 |
| CN | 207019379 | U | 2/2018 |
| CN | 110186236 | A | 8/2019 |
| CN | 210532785 | U | 5/2020 |

* cited by examiner

ADJUSTABLE RACK DEVICE AND REFRIGERATOR HAVING THE SAME

CROSS REFERENCE TO RELATED APPLICATIONS

The present invention is a 35 U.S.C. § 371 National Phase conversion of International (PCT) Patent Application No. PCT/CN2021/112833, filed on Aug. 16, 2021, which claims benefit of Chinese Application No. 202010838194.8, filed on Aug. 19, 2020, the disclosure of which is incorporated by reference herein. The PCT International Patent Application was filed and published in Chinese.

TECHNICAL FIELD

The present invention relates to an adjustable rack device and a refrigerator having the same, and in particular, to a position-adjustable rack with a slide rail and a refrigerator having the same.

BACKGROUND

Currently, in order to improve an internal volume rate of a refrigerator, a plurality of liner ribs which have fixed heights and are vertically arranged are generally arranged on an inner side of a refrigerating chamber of a mainstream refrigerator, and racks are arranged at heights corresponding to the liner ribs, such that more food can be stored utilizing the racks; however, since the heights of the racks are limited to be fixed by the heights of the liner ribs, when higher articles are required to be placed on the racks, the articles have to be transversely placed in the racks due to limitation of distances between the racks, thus occupying large parts of internal spaces of the racks, and reducing a space utilization rate of the refrigerator. Meanwhile, when switched to another liner rib, the rack is required to be manually removed from one liner rib and then placed on the other liner rib, and the operation is complex.

SUMMARY

An object of the present invention is to provide an adjustable rack device, which can solve a technical problem that a rack has a complex up-down movement process and is difficult to operate.

An object of the present invention is to provide a refrigerator having the adjustable rack device.

To achieve one of the above Objects, an embodiment of the present invention provides an adjustable rack device, comprising a rack assembly and a slide rail assembly, wherein the rack assembly comprises a rack body and a bracket, the slide rail assembly comprises a rail groove, and after the rack assembly is assembled on the slide rail assembly, the rail groove is perpendicular to the rack body, the rail groove is provided therein with at least two stop positions and a sliding plate fixedly connected with the bracket, the at least two stop positions are arranged at intervals in a direction of the rail groove, and the bracket and the stop positions can be selectively limited and fixed, a first end of an elastic assembly is provided at an end portion of the rail groove located at a supporting surface of the rack body, and a second end of the elastic assembly is connected with the sliding plate and gives an elastic restoring force towards the first end of the elastic assembly to the sliding plate.

As a further improvement of an embodiment of the present invention, the elastic assembly is a constant force coil spring having an elastic restoring force equal to gravity of the rack assembly, so as to counteract the gravity of the rack assembly completely.

As a further improvement of an embodiment of the present invention, the slide rail assembly comprises an elastic assembly fixing base, the elastic assembly fixing base is connected with one end of the rail groove and closes the end of the rail groove, and the first end of the elastic assembly is provided within the elastic assembly fixing base.

As a further improvement of an embodiment of the present invention, the stop position is provided within a strip-shaped stop portion, the strip-shaped stop portion is provided close to a back surface in the rail groove, and one end of the strip-shaped stop portion is provided with a supporting groove fitted with a port of the rail groove.

As a further improvement of an embodiment of the present invention, a first supporting point of an L-shaped handle structure is provided at one end of the bracket apart from the supporting surface of the rack body in a direction perpendicular to the rack body, the first supporting point and a first fitting portion in the stop position are limited and fixed, and the first fitting portion is configured to be a groove fitted with upper and lower end surfaces of the L-shaped handle structure.

As a further improvement of an embodiment of the present invention, a second supporting point is provided at a position of the bracket close to the supporting surface of the rack body in the direction perpendicular to the rack body, the second supporting point is configured as a protrusion having an inclined surface relative to the vertical direction, and the inclined surface of the protrusion and a second fitting portion in the stop position have a self-locking angle.

As a further improvement of an embodiment of the present invention, a pulley in snapped connection with a hook on the bracket is provided inside the sliding plate and, both ends of the pulley are fixed in grooves of the sliding plate, and the pulley can rotate with a connection line of the two fixed ends thereof as an axis.

As a further improvement of an embodiment of the present invention, the slide rail assembly comprises a slide rail, the slide rail comprises an inner rail and an outer rail, the inner rail is fixed to the sliding plate, the outer rail is fixed to both sides inside the rail groove, and the inner rail and the outer rail are slidably connected by balls.

As a further improvement of an embodiment of the present invention, two brackets and two slide rail assemblies are provided and fixed to both sides of the rack body respectively.

To achieve one of the above objects, an embodiment of the present invention provides a refrigerator, comprising storage compartments in different temperature regions and doors for opening and closing the storage compartments, wherein the refrigerator further comprises the adjustable rack device according to any of the above technical solutions, the adjustable rack device is provided in at least one storage compartment of the refrigerator, and the elastic assembly is provided above the rail groove.

Compared with a prior art, the adjustable rack device and the refrigerator having the same according to the present invention can more conveniently realize position adjustment, and meanwhile, a rack can be fixed at any position by a fitting structure in a rail groove, and has a good bearing performance and structural strength, thereby facilitating full utilization of a space in the refrigerator.

DETAILED DESCRIPTION

Hereinafter, the present invention will be described in detail in conjunction with specific embodiments shown in the accompanying drawings. However, these embodiments have no limitations on the present invention, and any transformations of structure, method, or function made by persons skilled in the art according to these embodiments fail within the protection scope of the present invention.

Figure 1:
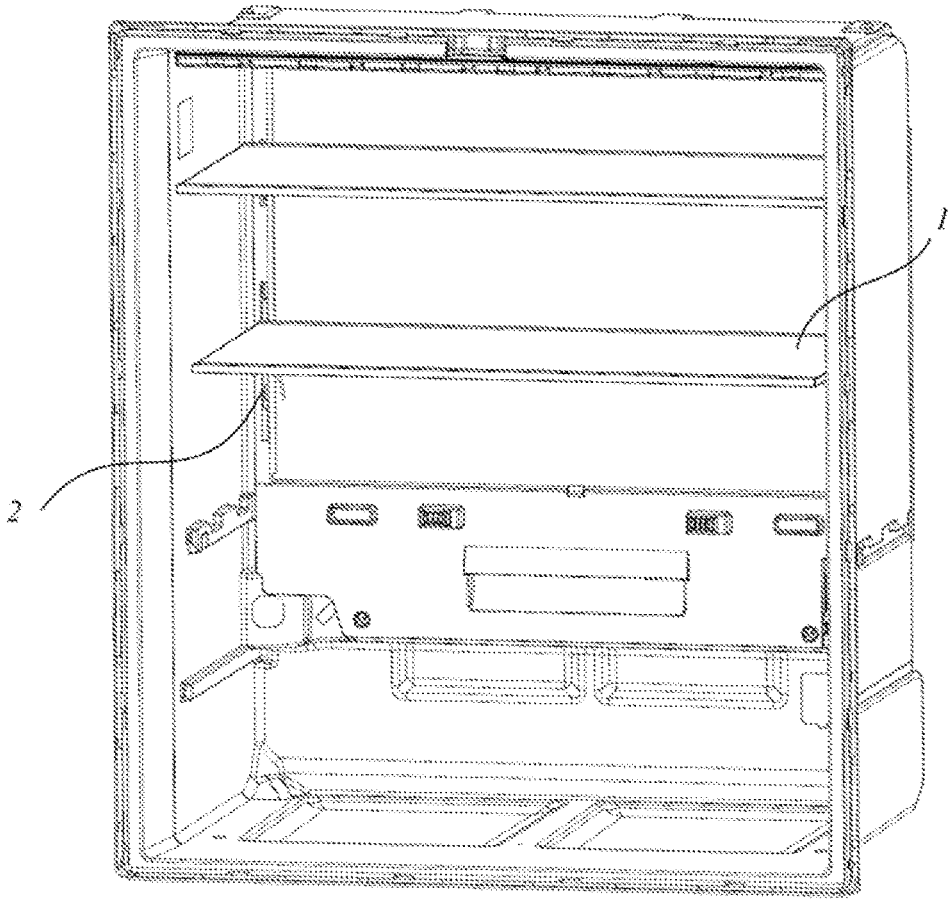
FIG. 1 is a schematic mounting diagram of an adjustable rack device in a refrigerator according to an embodiment of the present invention.

As shown in FIG. 1, in one embodiment of the present invention, an adjustable rack device may be provided in a refrigerator.

The refrigerator includes storage compartments in different temperature regions and doors for opening and closing the storage compartments. Usually, the refrigerator is provided therein with a refrigerating chamber having a temperature higher than 0 Celsius degree and a freezing chamber having a temperature lower than 0 Celsius degree. The adjustable rack device is arranged within at least one storage compartment of the refrigerator.

In the present embodiment, the adjustable rack device is provided in the refrigerating chamber to divide a storage space of the refrigerating chamber for article storage. Certainly, in other embodiments, the adjustable rack device can be provided in the freezing chamber and a variable temperature chamber.

For example, in the present embodiment, the adjustable rack device is provided in the refrigerating chamber, the rack device includes a rack assembly 1 and a slide rail assembly 2, the slide rail assembly 2 is provided at a rear panel of a refrigerating chamber cabinet, and the rack assembly 1 is provided in the storage space of the refrigerating chamber in a height-adjustable manner in cooperation with the slide rail assembly 2. One or more rack assemblies 1 can be provided, and one or more slide rail assemblies 2 can be provided.

In the present embodiment, the slide rail assembly 2 is arranged in a vertical direction of the refrigerating chamber, and when the rack assembly 1 is assembled to the slide rail assembly 2 and is stationary relative to the slide rail assembly 2, a rack body 11 of the rack assembly 1 is arranged horizontally. When the rear panel of the refrigerating chamber cabinet is vertically provided, the rack body 11 is perpendicular to the rear panel. In this way, an article placed on the rack body 11 can be more stable.

In the present embodiment, the rack assembly 1 is movable on the slide rail assembly 2; that is, the rack assembly 1 is configured to move in the vertical direction on the refrigerating compartment cabinet. The plurality of rack assemblies 1 can be moved to adjust distances therebetween and distances between the rack assemblies 1 and top and bottom boards of the refrigerating chamber cabinet to accommodate to store more articles with different heights.

Figure 2:
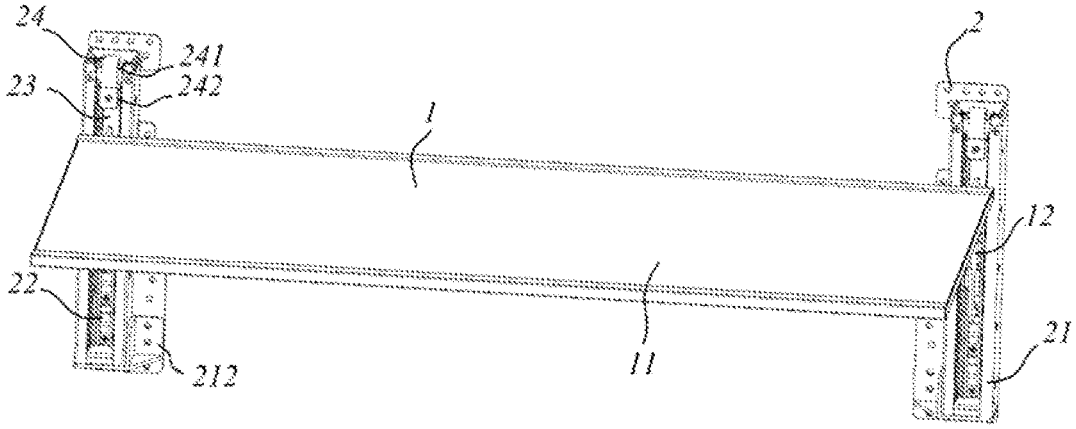
FIG. 2 is a schematic diagram of an assembled adjustable rack device according to an embodiment of the present invention.
Figure 3:
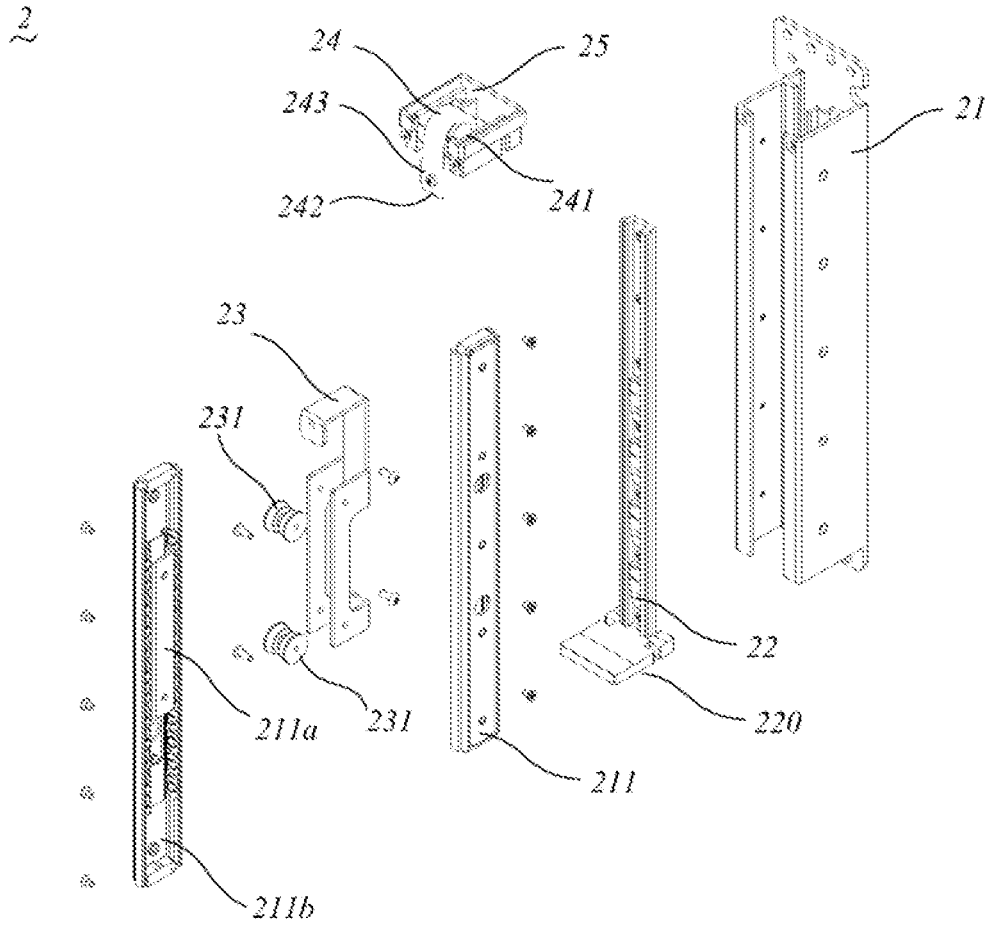
FIG. 3 is a schematic exploded structural diagram of a slide rail assembly of an adjustable rack device according to an embodiment of the present invention.
Figure 4:
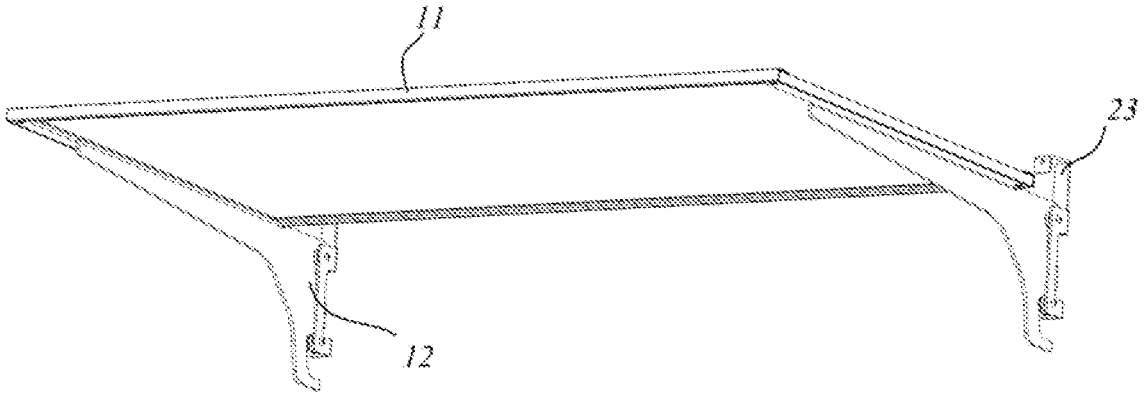
FIG. 4 is a schematic assembly diagram of a rack assembly and a sliding plate of an adjustable rack device according to an embodiment of the present invention.

As shown in FIGS. 2 to 4, in the present embodiment, the rack assembly 1 includes the rack body 11 and a bracket 12. One bracket 12 may be provided in a middle portion of the rack body 11, or a plurality of brackets 12 may be arranged on a bottom surface or side surface of the rack body 11. In the present embodiment, the brackets 12 are fixed on both sides of the rack body 11, such that both sides of the rack body 11 can be kept balanced in a process of adjusting a vertical position of the rack body 11, and both sides can be lifted synchronously.

In the present embodiment, the slide rail assembly 2 includes a rail groove 21, a stop position 22, a sliding plate 23, and an elastic assembly 24.

The stop position 22 and the sliding plate 23 are provided inside the rail groove 21, and the sliding plate 23 is slidably connected to the rail groove 21. Furthermore, the elastic assembly 24 is fixed to a top end of the rail groove 21.

The rail groove 21 is provided with at least two stop positions 22 at intervals in the vertical direction, and density of the stop positions can be controlled according to an application requirement of the adjustable rack device, such that the bracket 12 can be selectively limited and fixed to the stop positions. In the present embodiment, the stop position 22 is provided close to a back surface of the rail groove 21. Certainly, in other embodiments, the stop position 22 may be provided close to a side surface of the rail groove 21.

As shown in FIG. 3, in the present embodiment, when the rail groove 21 is arranged in the vertical direction, the stop position 22 is provided in a strip-shaped stop portion 220, and the strip-shaped stop portion 220 is provided close to a back surface in the rail groove 21, such that relative movement between the sliding plate 23 and the rail groove 21 is not affected while a stop effect is kept, and disassembly and replacement can be facilitated. Certainly, other embodiments exist, for example, the stop portions 220 are provided close to two sides inside the rail groove 21, which can also achieve the effect of stopping the bracket 12.

A lower end of the stop portion 220 is provided with a supporting groove which can be fixed to a lower port of the rail groove 21, such that a lower end of the rail groove 21 is sealed to limit the sliding plate 23 in the rail groove 21. Further, slide rails 211 are arranged on both sides inside the rail groove 21. Certainly, in other embodiments, such as those in which the stop positions 22 are arranged on both sides inside the rail groove 21, the slide rail 211 may be fixed to the back surface of the rail groove 21.

In the present embodiment, the slide rail 211 includes an inner rail 211*a* and an outer rail 211*b*, and the inner rail 211*a* and the outer rail 211*b* are slidably connected by balls. The inner rail 211*a* is fixed to the sliding plate 23, and the outer rail 211*b* is fixedly connected to an inner side wall of the rail groove 21.

The sliding plate 23 can drive the inner rail 211*a* to move relative to the outer rail 211*b* and the rail groove 21 to which the outer rail is fixed through the balls between the inner rail and the outer rail 211*b* when the sliding plate is forced to move up and down.

In the present embodiment, a pulley 231 in snapped connection with a hook of the bracket 12 is provided inside the sliding plate 23, two ends of the pulley 231 are fixed in a groove formed in the sliding plate 23, the pulley 231 can rotate with a connection line of the two fixed ends thereof as an axis, and the fitting structure of the pulley 231 and the hook can provide a supporting force for the sliding plate 23 in the vertical direction during up-down movement of the rack assembly 1.

Further, a first end 241 of the elastic assembly 24 is provided at the top end of the vertically arranged rail groove 21, and a second end 242 of the elastic assembly is in a free state, such that the elastic assembly 24 can be elastically deformed by applying a pulling force, and then, the second end 242 can be pulled to be connected to a top end of the sliding plate 23, thereby providing an elastic restoring force towards the first end 241 of the elastic assembly 24 for the sliding plate 23.

In order to protect an appearance and function of the second end 242 of the elastic assembly, a fixed sheet 243 is provided at a portion where the second end 242 of the elastic assembly is fixedly overlapped with the sliding plate 23, and screw holes with a same size are provided at corresponding positions of the second end 242 of the elastic assembly, an upper end of the sliding plate 23, and the fixed sheet 243 respectively, such that an integral structure is formed by screw fixation, and service life of the elastic assembly 24 is prolonged.

In the present embodiment, the elastic assembly 24 includes an elastic assembly fixing base 25, and the elastic assembly fixing base 25 is provided therein with an accommodating portion capable of accommodating the first end 241 of the elastic assembly. In the present embodiment, a transverse rod is provided in the accommodating portion, the elastic assembly 24 is configured in a hollow winding shape, the transverse rod is inserted into the hollow portion, and two ends of the transverse rod are fixedly connected to a housing of the elastic assembly fixing base 25, such that the elastic assembly 24 is connected to the elastic assembly fixing base 25.

The elastic assembly fixing base 25 can be in snapped connection with the top end of the rail groove 21, and the elastic assembly fixing base 25, the rail groove 21 and the supporting groove at the bottom of the stop portion 220 form a closed space, such that a moving position of the sliding plate 23 is limited, and the sliding plate is prevented from being separated from an upper port and the lower port of the rail groove 21. The slide rail 211, the sliding plate 23, the pulley 231 fixed on the sliding plate 23, and the second end 242 of the elastic assembly 24 connected to the sliding plate 23 are fixed inside the closed structure.

During assembly to the refrigerator, the rail groove 21 is fixed onto the rear panel of the refrigerator compartment through the screw holes provided on the back surface, the lower end of the rail groove 21 is preferably provided with a fixed block 212, a lower surface of the fixed block 212 is in partial surface contact with an upper surface of the rail groove 21, screw holes on the fixed block correspond to the screw holes on the rail groove, and after the rail groove 21 is placed on a surface of the rear panel, the fixed block 212 corresponds to the rail groove 21, and the fixed block and the rail groove are fixed on the rear panel of the refrigerating chamber together by screws, thus enhancing overall structural strength.

As shown in FIG. 4, after the assembly of the slide rail assembly 2 is completed, the pulley 231 inside the sliding plate 23 is fitted with the hook on the bracket 12, thereby completing assembly of the rack assembly 1.

It may be appreciated that the rail groove 21 is perpendicular to the rack body 11 after the rack assembly 1 is assembled to the slide rail assembly 2 and gets into a relatively stationary state. The rack body 11 is relatively fixed to the sliding plate 23 by the bracket 12, and the sliding plate 23 is slidably assembled onto the rail groove 21.

In the present embodiment, the elastic assembly 24 is configured as a constant force coil spring having a constant elastic coefficient, a change in an elastic force is negligible during an elastic deformation process, and the constant force coil spring preferably has a type capable of providing an elastic force equal to gravity of the rack assembly 1, so as to counteract the gravity of the rack assembly 1 during a movement process thereof.

Figure 5:
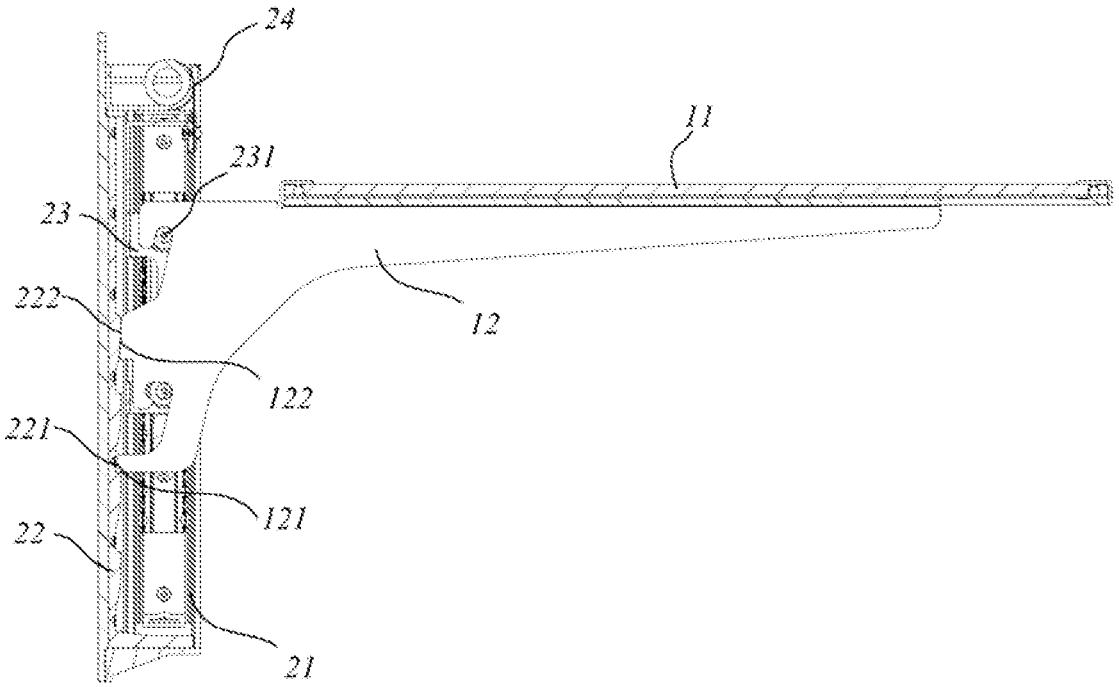
FIG. 5 is a schematic diagram of an adjustable rack device in a stationary state according to an embodiment of the present invention.

FIG. 5 shows the adjustable rack device in the stationary state, a first supporting point 121 is provided at one end of the bracket 12 apart from a supporting surface of the rack body 11 in the vertical direction, the first supporting point 121 is preferably designed into an L-shaped handle structure, the first supporting point and a first fitting portion 221 in the stop position 22 provided inside the rail groove 21 are limited and fixed, and preferably, the first fitting portion 221 is configured as a groove which is configured to be fitted with upper and lower end surfaces of the L-shaped handle structure and has an L-shaped cross section.

Further, a second supporting point 122 is provided at a position of the bracket 12 close to the supporting surface of the rack body 11 in the vertical direction, and configured as a protrusion which has an inclined surface inclined relative to the vertical direction, the inclined surface and a second fitting portion 222 in the stop position 22 have a self-locking angle, and the self-locking angle can provide the rack assembly 1 in a non-bearing state with a friction force, such that relative movement between the rack assembly and the strip-shaped stop portion 220 is avoided, and on the other hand, the fitting structure can reduce wear of the first supporting point 121 and the first fitting portion 221 to a certain extent.

In the stationary state, the first fitting portion 221 in the stop position 22 and the first supporting point 121 on the bracket 12 are limited and fixed, and at this point, the first fitting portion is in surface contact with a lower end surface of the first supporting point 121, and meanwhile, the second supporting point 122 and the second fitting portion 222 are self-locked, and when a surface of the rack body 11 bears a load, due to a lever principle, the first supporting point 121 and the second supporting point 122 provide horizontal pressure towards an interior of the stop position 22 to the first fitting portion 221 and the second fitting portion 222 respectively, and correspondingly obtain opposite supporting forces provided by the first fitting portion 221 and the second fitting portion 222 respectively, and at this point, due to a friction coefficient between the supporting point and the stop position 22, the friction force of contact portions is increased, such that an overall structure of the rack device is stable.

Figure 6:
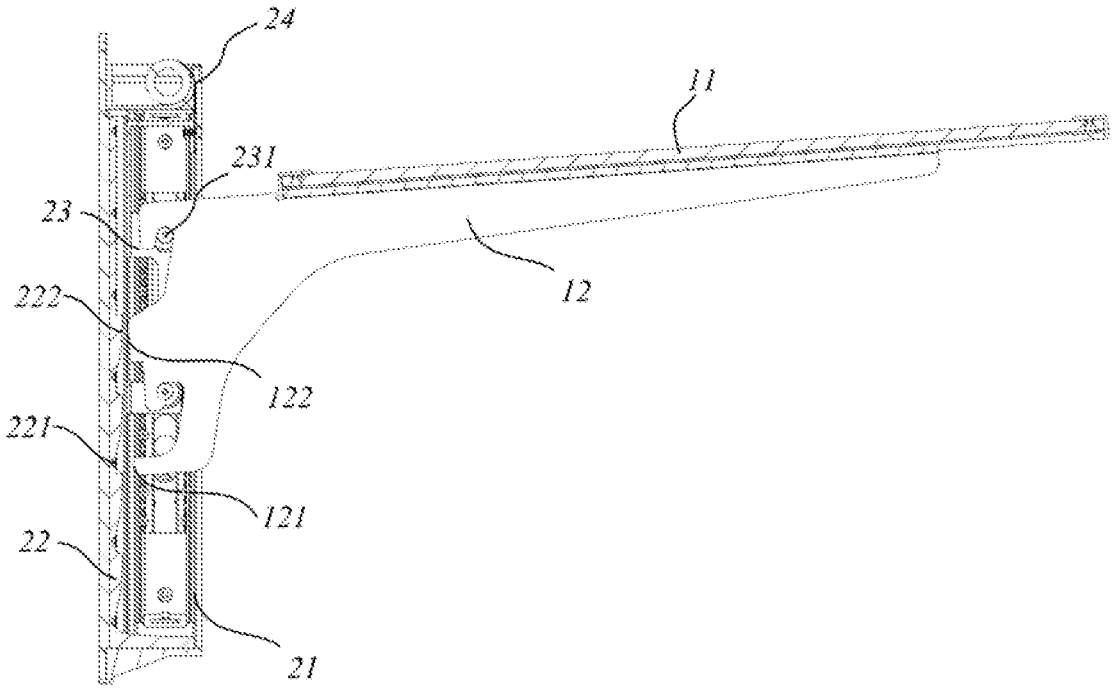
FIG. 6 is a schematic diagram of an adjustable rack device in a sliding state according to an embodiment of the present invention.

When the rack body 11 is lifted up in the stationary state, the rack assembly 1 is rotated by a certain angle with the pulley 231 limited and fixed onto the bracket 12 and close to one end of the supporting surface of the rack body 11 as a rotation axis, and the rack device is switched to a moving state, as shown in FIG. 6.

At this point, the first supporting point 121 is separated from the first fitting portion 221, and the second supporting point 122 is separated from the second fitting portion 222, thereby releasing the limitation and self-locking structure. Further, the rack body 11 is lifted or pushed down in the vertical direction, the sliding plate 23 fixed to the bracket 12 can move up and down in the vertical direction along the rail groove 21, and in the moving process, the elastic assembly 24 fixed to the top end of the rail groove 21 continuously provides the elastic restoring force for the sliding plate 23, such that a user can adjust the position of the rack assembly 1 only by overcoming a sliding friction force in the rail groove 21.

Compared with a prior art, the adjustable rack device and the refrigerator according to the present invention can more conveniently realize position adjustment, the user can adjust the position of the rack body 11 without overcoming gravity of a rack, and meanwhile, the rack body 11 can be fixed at any position by the fitting structure in the rail groove 21, and keeps a good bearing performance and structural strength, thereby facilitating full utilization of the space in the refrigerator. Meanwhile, the adjustable rack device according to the present invention is not only suitable for the refrigerator, but also can be applied to the fields of display cases, or the like, on a complete structure premise, and is used for replacing a traditional rack, or the like, so as to achieve an effect of conveniently adjusting the position of the rack.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

A series of the detailed descriptions set forth above is merely specific description of feasible embodiments of the present invention, and is not intended to limit the protection scope of the present invention. Equivalent embodiments or modifications made within the spirit of the present invention shall fall within the protection scope of the present invention.

What is claimed is:

1. An adjustable rack device, comprising a rack assembly and two slide rail assemblies;

wherein the rack assembly comprises a rack body and two brackets, the two brackets and two slide rail assemblies are connected to two opposite sides of the rack body respectively, each of the slide rail assemblies comprises a rail groove, and after the rack assembly is assembled on the slide rail assemblies, the rail groove of the each slide rail assembly extends perpendicularly to the rack body;

the rail groove of the each slide rail assembly is configured to receive therein at least two stop positions and a sliding plate connected with the corresponding bracket of the each slide rail assembly;

the at least two stop positions are arranged at intervals in an extension direction of the rail groove of the each slide rail assembly, and each of the brackets and the corresponding stop positions of the each bracket are selectively limited and engaged;

a first end of an elastic assembly is provided at an end portion of the rail groove of the each slide rail assembly, and a second end of the elastic assembly is connected with the corresponding sliding plate of the elastic assembly and gives an elastic restoring force towards the first end of the elastic assembly to the corresponding sliding plate of the elastic assembly.

2. The adjustable rack device according to claim 1, wherein the elastic assembly is a constant force coil spring having an elastic restoring force equal to gravity of the rack assembly.

3. The adjustable rack device according to claim 1, wherein the each slide rail assembly comprises an elastic assembly fixing base, the elastic assembly fixing base is connected at one end of the rail groove and closes the one end of the rail groove, and the first end of the elastic assembly is provided within the elastic assembly fixing base.

4. The adjustable rack device according to claim 1, wherein the at least two stop positions are provided within a strip-shaped stop portion, the strip-shaped stop portion is provided next to a back surface in the rail groove, and one end of the strip-shaped stop portion is provided with a supporting groove fitted with a port of the rail groove.

5. The adjustable rack device according to claim 1, wherein a first supporting point of an L-shaped handle structure is provided at one end of the each bracket apart from a supporting surface of the rack body in a direction perpendicular to the rack body, the first supporting point and a first fitting portion in the corresponding stop position of the first supporting point are limited and engaged, and the first fitting portion is configured to be a groove fitted with upper and lower end surfaces of the L-shaped handle structure.

6. The adjustable rack device according to claim 5, wherein a second supporting point is provided at a position of the each bracket close to the supporting surface of the rack body in the direction perpendicular to the rack body, the second supporting point is configured as a protrusion having an inclined surface relative to the perpendicular direction, and the inclined surface of the protrusion and a second fitting portion in the corresponding stop position of the second supporting point have a self-locking angle.

7. The adjustable rack device according to claim 1, wherein a pulley in snapped connection with a hook on the each bracket is provided inside the sliding plate and, both ends of the pulley are fixed in grooves of the sliding plate, and the pulley can rotate with a connection line of the two fixed ends of the pulley as an axis.

8. The adjustable rack device according to claim 1, wherein the each slide rail assembly comprises a slide rail, the slide rail comprises an inner rail and an outer rail, the inner rail is fixed to the sliding plate, the outer rail is fixed to both sides inside the rail groove, and the inner rail and the outer rail are slidably connected by balls.

9. A refrigerator comprising storage compartments in different temperature regions, and doors for opening and closing the storage compartments, wherein the refrigerator further comprises the adjustable rack device according to claim 1, the adjustable rack device is provided in at least one storage compartment of the refrigerator, and the elastic assembly is provided above the rail groove.

* * * * *